US011247879B2

(12) United States Patent
Stensland

(10) Patent No.: US 11,247,879 B2
(45) Date of Patent: Feb. 15, 2022

(54) WINCH SYSTEM

(71) Applicant: MHWIRTH AS, Kristiansand (NO)

(72) Inventor: Eivind Gimming Stensland, Kristiansand (NO)

(73) Assignee: MHWIRTH AS, Kristiansand S (NO)

( * ) Notice: Subject to any disclaimer, the term of this patent is extended or adjusted under 35 U.S.C. 154(b) by 905 days.

(21) Appl. No.: 15/743,670

(22) PCT Filed: Jun. 28, 2016

(86) PCT No.: PCT/NO2016/050146
§ 371 (c)(1),
(2) Date: Jan. 11, 2018

(87) PCT Pub. No.: WO2017/010890
PCT Pub. Date: Jan. 19, 2017

(65) Prior Publication Data

US 2019/0077641 A1 Mar. 14, 2019

(30) Foreign Application Priority Data

Jul. 14, 2015 (NO) ..... 20150919

(51) Int. Cl.

| | |
|---|---|
| ***B66D 1/14*** | (2006.01) |
| ***B66D 1/52*** | (2006.01) |
| ***B66D 1/08*** | (2006.01) |
| ***B66D 1/12*** | (2006.01) |
| *B66D 1/18* | (2006.01) |

(52) U.S. Cl.
CPC ..... *B66D 1/14* (2013.01); *B66D 1/08* (2013.01); *B66D 1/12* (2013.01); *B66D 1/525* (2013.01); *B66D 1/18* (2013.01)

(58) Field of Classification Search
CPC ... B66D 1/08; B66D 1/12; B66D 1/14; B66D 1/18; B66D 1/525
See application file for complete search history.

(56) References Cited

U.S. PATENT DOCUMENTS

| | | | | |
|---|---|---|---|---|
| 3,090,361 | A | 5/1963 | Orshansky, Jr. | |
| 3,815,478 | A | 6/1974 | Axelsson et al. | |
| 3,893,572 | A | 7/1975 | Axelsson et al. | |
| 5,224,411 | A | 7/1993 | Fillion | |
| 6,575,078 | B1 | 6/2003 | Wright et al. | |
| 2005/0179021 | A1 | 8/2005 | Selcer et al. | |
| 2012/0305513 | A1 | 12/2012 | Müller et al. | |
| 2015/0083985 | A1 | 3/2015 | Lervik | |
| 2015/0361736 | A1* | 12/2015 | Bergan | E21B 19/09 414/803 |

(Continued)

FOREIGN PATENT DOCUMENTS

| | | | |
|---|---|---|---|
| CN | 101395084 | A | 3/2009 |
| DE | 37 44 215 | A1 | 7/1989 |
| DE | 195 39 043 | A1 | 4/1997 |

(Continued)

*Primary Examiner* — Sang K Kim
*Assistant Examiner* — Nathaniel L Adams
(74) *Attorney, Agent, or Firm* — Norman B. Thot

(57) ABSTRACT

A winch system for driving an output includes a gear connected to the output, an electric motor connected to the gear, and a hydraulic motor connected to the gear. The electric motor and the hydraulic motor are distribute energy via the gear to the output.

12 Claims, 14 Drawing Sheets

(56) References Cited

U.S. PATENT DOCUMENTS

2016/0152451 A1 6/2016 Vestre

FOREIGN PATENT DOCUMENTS

| | | | | | |
|---|---|---|---|---|---|
| EP | 2 287 105 | A2 | | 2/2011 | |
| WO | WO-2006008052 | A1 | * | 1/2006 | ..... B66D 1/08 |
| WO | WO 2013/147613 | A1 | | 10/2013 | |
| WO | WO 2014/200354 | A1 | | 12/2014 | |

* cited by examiner

WINCH SYSTEM

CROSS REFERENCE TO PRIOR APPLICATIONS

This application is a U.S. National Phase application under 35 U.S.C. § 371 of International Application No. PCT/NO2016/050146, filed on Jun. 28, 2016 and which claims benefit to Norwegian Patent Application No. 20150919, filed on Jul. 14, 2015. The International Application was published in English on Jan. 19, 2017 as WO 2017/010890 A2 under PCT Article 21(2).

FIELD

The present invention relates to a winch system for driving a winch.

BACKGROUND

Winches are used onshore, offshore, on rigs, on vessels and in mobile or marine applications to hoist and lower a load, to provide a constant tension or to keep a load in a position compensating for a motion. The winch can be configured as single line or multiline with single layer or multi-layer. The wireline can also be a chain or other flexible element suitable to be operated by a winch.

Such a winch can be used as a hoisting system for offshore or onshore drilling rigs used for exploration drilling, oil and gas production or well services, or as part of a crane used onshore, in mobile application, in mining, offshore or in marine applications. Examples of cranes using winches are offshore load handling cranes, deck cranes, ship cranes, dockside cranes, container cranes, floating lifting cranes, mobile harbor cranes, tower cranes, telescopic mobile cranes, bulk unloader cranes, container handling cranes, gantry cranes, mooring, and piling cranes.

A known solution for power transmission in winches is to use electrical motors controlled by variable frequency converters (VFD) and a control system. The electrical motors are typically connected to a gearbox, which is again connected to the shaft of the winch. When decelerating or braking, regeneration of power can be achieved, storing the power in an electrical storage system or feeding it to other consumers. This reduces energy consumption. FIG. 1 shows, schematically, an operating setup with energy flows for a typical installation on a vessel or a rig. A combustion engine or gas turbine 1 drives a generator 2 producing electrical power 3. A winch with electrical motors converts the electrical power to mechanical power 4, giving torque and speed output 5 to the winch drum and hoisting line(s). When it is required to brake the load, power from the load will be transferred to the drum, producing mechanical power 4 which is converted to electrical power 3 which can be transferred through VFDs to an electrical storage system 6 where the energy can be used later when hoisting, accelerating the load or by another consumer on the vessel or the rig. This setup allows the combustion engine and generator to be designed according to the average power requirements giving a possible reduced size of combustion engine and generator. This reduces the cost of the installation of combustion engine and the generator.

Another known solution is to use winches with hydraulic motors. These motors can either be fixed or with a variable displacement, either of digital displacement type or conventional, whereby the digital displacement type provides better efficiency at different working conditions. The motors are often connected to a gearbox. When decelerating or braking a load, regeneration of power can be used where the fluid power is stored in a hydraulic accumulator. This will, equivalently to that described above, reduce fuel consumption and carbon dioxide emissions.

SUMMARY

In an embodiment, the present invention provides a winch system for driving an output which includes a gear connected to the output, an electric motor connected to the gear, and a hydraulic motor connected to the gear. The electric motor and the hydraulic motor are configured to distribute energy via the gear to the output.

BRIEF DESCRIPTION OF THE DRAWINGS

The present invention is described in greater detail below on the basis of embodiments and of the drawings in which.

DETAILED DESCRIPTION

Figure 1:
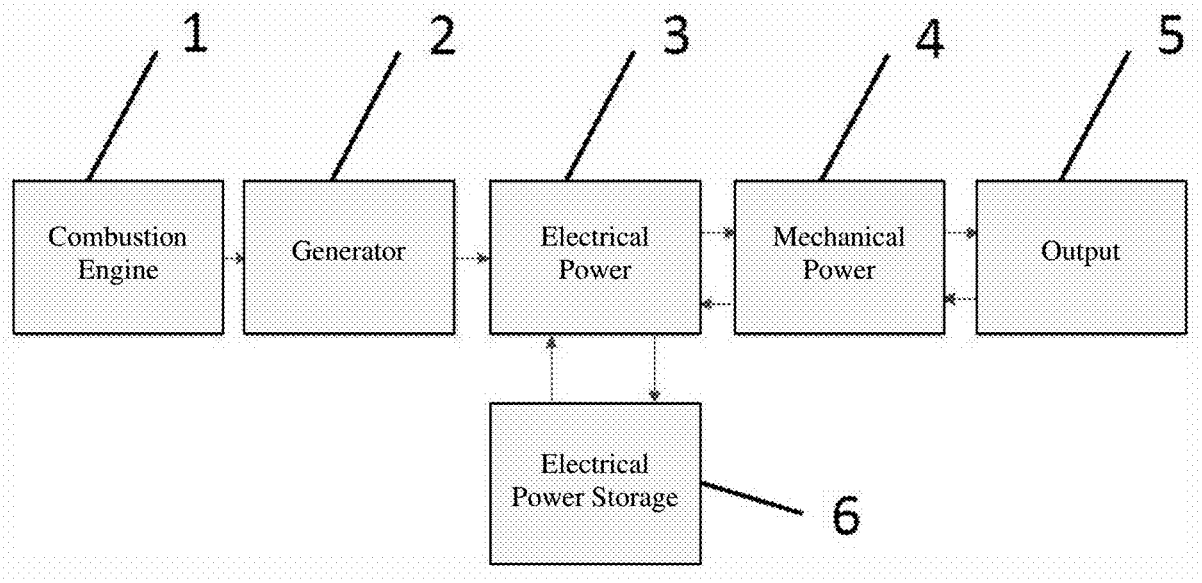
Fig. 1 (Prior Art)
FIG. 1 illustrates a winch setup with electrical motors and electrical storage system on a vessel according to prior art.

Embodiments of the present invention relate to a winch system which may be driven using electrical motor(s) and hydraulic motor(s), and a mechanical energy transmission system, such as a gear or system of gears, to transmit energy between the motors and the winch while manipulating a load.

A control system can, for example, be used comprising control module(s) to control the transmission of energy between the motors and the winch using the mechanical energy transmission system. The control system is multifunctional and may incorporate additional modules for control of systems associated with the motors, winch, and energy transmission system. These components comprise a basic winch system; additional features may be added to build a more comprehensive winch system.

An energy storage system is optionally available and used to store energy transferred from the motors and winch for later use by the winch system. The energy storage system may also be made available to alternative systems, for example, a consumer using an electrically operated apparatus may draw energy from the energy storage system.

The stored energy in the energy storage system may be used by the winch system for purposes such as, but not limited to, heave compensation, powering supplementary motors, such as drum motor, of the winch system, driving a portable/mobile winch system, and driving a secondary winch system.

The winch system may be a mobile winch system which is, for example, transportable using a transport device.

A drum motor may be used to drive a winch operating on a load. The drum motor has an axial inner shaft with an array of actuators or hydraulic cylinders arranged radially around the axial inner shaft. One end of the actuators operates against a modulated internal surface of a cam ring to rotatably drive the cam ring. The cam ring outer surface may form the outer portion of a winch drum or may be arranged so that the cam ring drives a winch drum. The drum motor can, for example, be at least partially positioned inside the winch drum.

Embodiments of the present invention seek to improve on the requirement of the amount and form of energy used in a winch system. Particular issues arise around the availability of energy in a particular form, for example, electrical energy may be limited in the field and may have adverse effects on the winch system if insufficient electrical energy is available.

A first aspect of the present invention provides a winch system driving an output comprising: a gear connected to the output; an electric motor connected to the gear; and a hydraulic motor connected to the gear, wherein the electric motor and the hydraulic motor are operable to distribute energy via the gear to the output.

Another aspect provides the winch system further comprising the electric motor and the hydraulic motor being operable to distribute energy between each other via the gear.

The electric motor and the hydraulic motor can, for example, be connected to respective electric and hydraulic power systems, with energy distributed between the electric motor and the hydraulic motor further being distributed to the respective power systems.

The further distributed energy can, for example, be stored by the respective power systems in an electric energy storage unit and a hydraulic energy storage unit.

The winch system can, for example, further comprise a heave compensation module operable to control the energy distribution between the electric power system, the hydraulic power system and the output using the electric motor, the hydraulic motor, and the gear; or the heave compensation module operable to control the energy distribution between the electric power system, the hydraulic power system and the output using the hydraulic motor to provide passive heave compensation and the electric motor to provide active heave compensation.

The heave compensation module can, for example, further control the energy distribution to overcome frictional forces.

The output can, for example, be connected to at least one of: a winch drum; and a clutch connected to a winch drum.

The gear can, for example, be at least one of: a planetary gear train; and a series of gears; and/or wherein the hydraulic energy storage system is at least one of: an accumulator and accumulator cylinder; and a flywheel; and/or the system further comprising a mobile unit with a power source operable to move the energy distribution system.

Another aspect of the present invention uses a drum motor for a winch system, the motor comprising: an axial inner shaft; an array of hydraulic cylinders arranged radially around the axial inner shaft; and a cam ring having an internal surface with a profile modulated in the radial direction, wherein the array of hydraulic cylinders is disposed between the axial inner shaft and the modulated profile of the cam ring and actuation of the array of hydraulic cylinders rotatably drives the cam ring around the axial inner shaft.

The drum motor can, for example, further comprise one or more valves to control actuation of the array of hydraulic cylinders.

One valve can, for example, be connected to a high pressure fluid source and another valve can, for example, be connected to a low pressure fluid source.

A control system can, for example, be operable to selectively enable and/or disable one or more of the hydraulic cylinders in the array using one of the valves.

A selection of the hydraulic cylinders can, for example, provide heave compensation.

In a further aspect of the present invention, the drum motor and winch system as described above and various combinations form a hybrid winch system.

In a further aspect of the present invention, the drum motor is operable to receive and distribute energy to the electric motor and/or the hydraulic motor using the gear of the winch system.

Embodiments off the present invention are described below, by way of example, with reference to the accompanying drawings.

Figure 2:
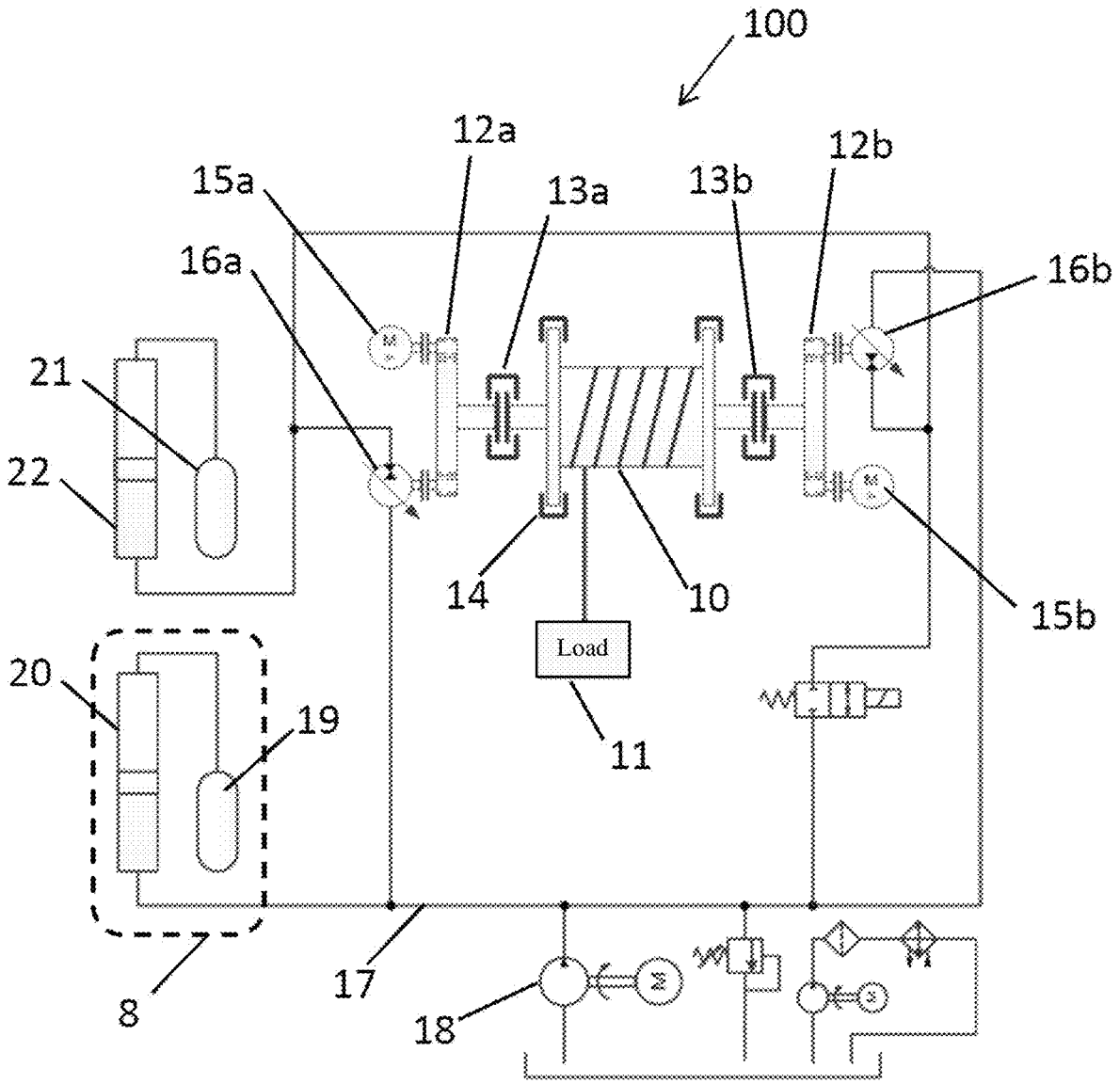
FIG. 2 illustrates a winch system according to an embodiment of the present invention, with optional features shown.

Referring to the drawings and in particular FIG. 2, one embodiment of the present invention is a winch system 100 with a winch having a winch drum 10, adapted to hoist a load 11 via a hoisting member such as a wire or a rope. A mechanical energy transmission system comprising a first gear 12*a* and, optionally, a second gear 12*b* are connected to the winch drum 10, for example, via clutches 13*a* and 13*b*, respectively.

Figure 7:
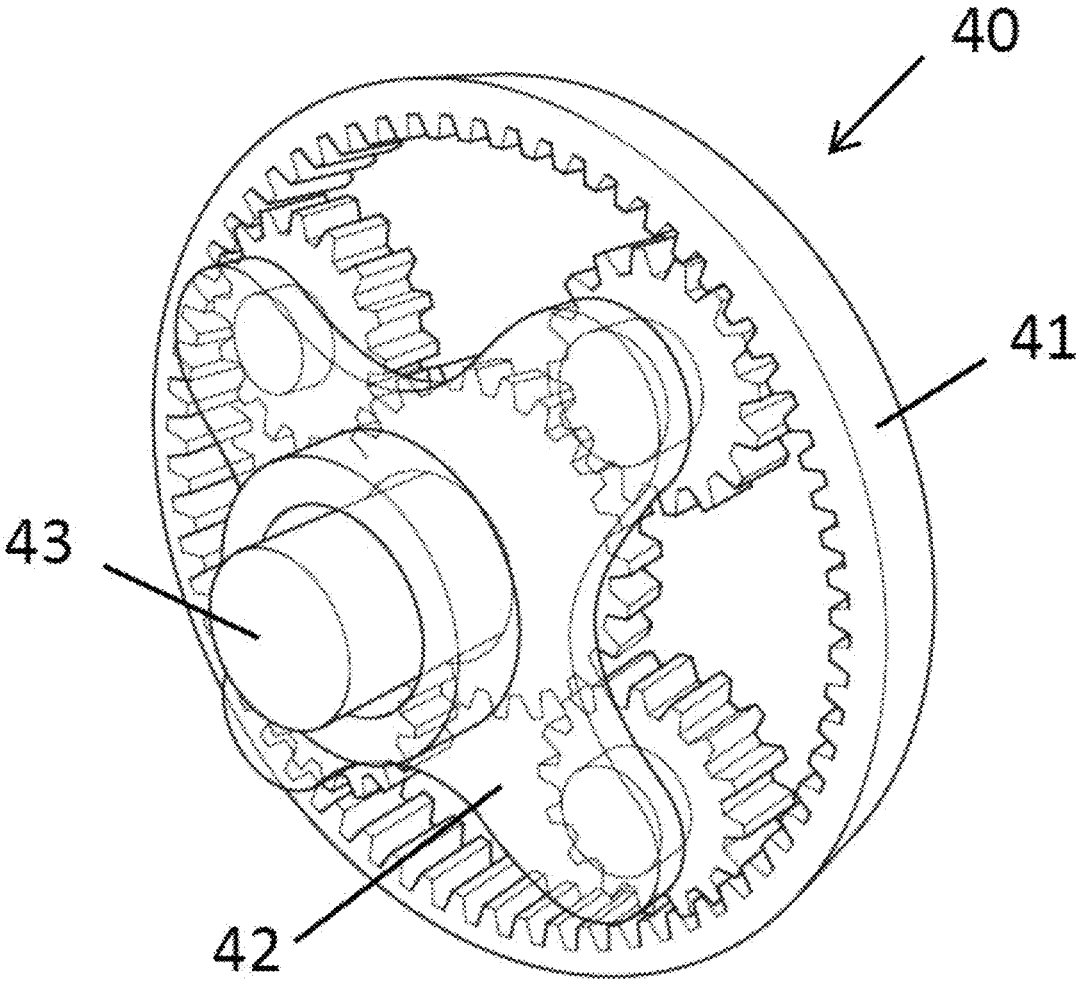
FIG. 7 illustrates a planetary, or epicycle, gear train for use with embodiments of the present invention.

The gears 12*a* and 12*b* may be of any type, such as a conventional gearbox or a planetary gear train (see FIG. 7). The clutches 13*a* and 13*b* may be of "dog clutch" design on the outgoing main shaft from the respective gear 12*a* or 12*b*, and connected to the winch drum 10 to allow the main shaft to be engaged and disengaged from the winch drum. The winch drum 10 can, for example, also have a set of brakes 14 which can be used to hold the drum at standstill. A double set of brakes can be used to have a redundant braking system or as a failsafe or emergency braking system.

Electric motor 15*a*, and optionally 15*b*, are coupled to the gears 12*a* and 12*b*, respectively. Hydraulic motors 16*a*, and optionally 16*b*, are similarly, coupled to the gears 12*a* and 12*b*. The electric motors 15*a* and 15*b* receive electric power through an electrical power system supply line (not shown), for example, from a diesel generator set or from an electrical grid. The hydraulic motors 16*a* and 16*b* can, for example, be operated using a hydraulic power system connected by a distribution line 17. The hydraulic power system may include a hydraulic pump unit 18 for providing hydraulic energy.

Another embodiment may include an energy storage system 6 and 8. The energy storage system may comprise separate units for storage of electrical energy and storage of mechanical energy. An example of an electrical storage system is an electrical storage unit, a cell, or cells formed into batteries to store electrical energy. Examples of mechanical energy storage systems are: a hydraulic energy storage unit (using a pressurized fluid), for example, an accumulator and accumulator cylinder; and a flywheel 54. The examples do not limit the scope of the present invention and alternative electrical and mechanical energy storage mechanisms may be used in any combination.

If an energy storage system is installed and made available, the electric motors and hydraulic motors may receive energy from their respective energy storage units in addition or instead of the respective power systems.

The hydraulic energy storage unit 8 comprises an accumulator 19 and an accumulator cylinder 20. The accumulator cylinder 20 has a piston separating an oil side and a gas side, whereby the gas side is connected with accumulator 19. The gas side may comprise nitrogen under high pressure. The hydraulic energy storage unit 8 thus allows the storage of hydraulic power in the pressure accumulator 19 and in the accumulator cylinder 20. The hydraulic power system may optionally comprise a second accumulator 21 and accumulator cylinder 22. The two respective hydraulic energy storage units may operate at different hydraulic pressures. For example, one operates as a high pressure unit and the other as a low pressure unit.

As an alternative, the high and (if applicable) the low pressure accumulators 19 and 21 may be simple bladder accumulators, thus eliminating the need for accumulator cylinders 20 and 22.

Electric motors 15*a* and 15*b*, and hydraulic motors 16*a* and 16*b* are controllable, so that the power or torque applied by each motor on the gear 12*a*/12*b* and thereby on the winch drum 10 which can be regulated, for example, by a control system, or a module of the control system. For a lifting or lowering operation, the control system may thus, for example, use electric power, hydraulic power, or both depending on the specific type of operation and the availability of electric and hydraulic energy of the winch system.

The control system manages the distribution of energy to minimize the energy used by the winch system when operating on a load. Energy efficiencies, by minimizing energy use in the winch system, may be achieved by balancing the energy between the energy used and generated by the individual motors of the winch system and any potential/kinetic energy of the winch load.

The control system may further use the energy storage system to store the energy in the winch system, including any energy recovered from the winch load, for use later for alternative purposes, for example, but not limited to, heave compensation.

Figure 3:
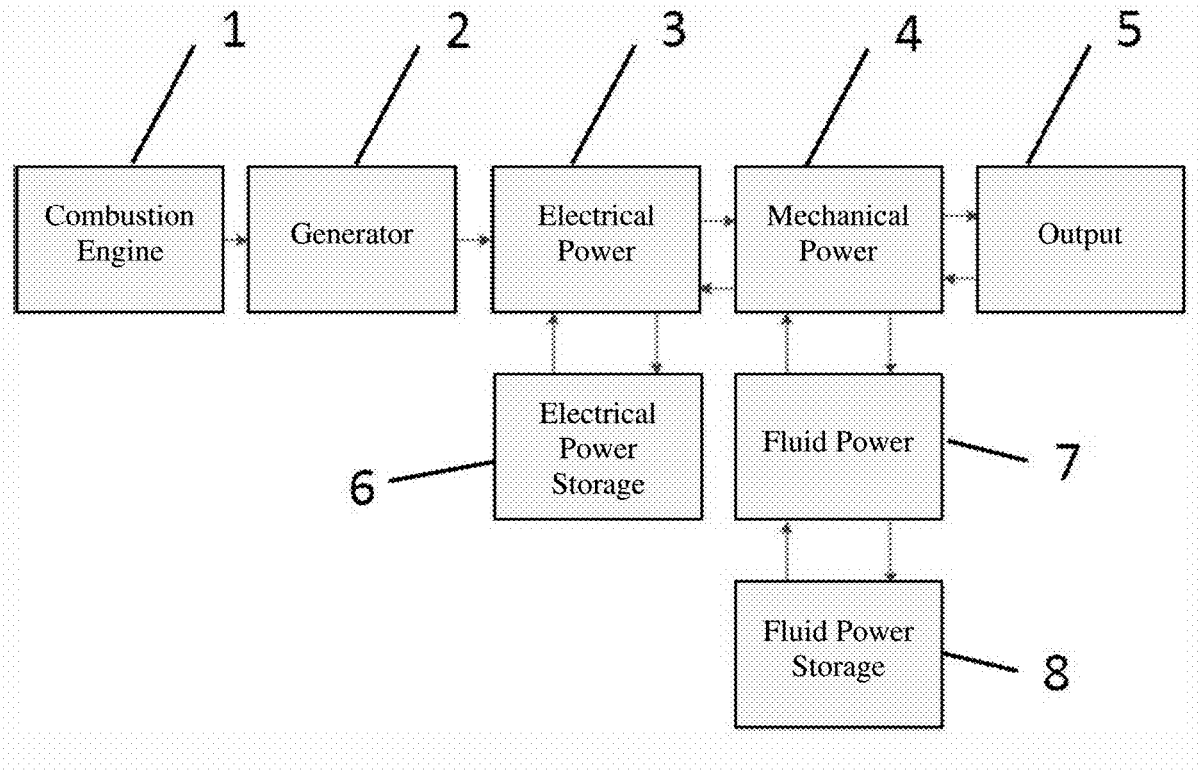
FIG. 3 illustrates a winch system flow chart with electrical motors, an electrical energy storage system, and a mechanical energy storage system (hydraulic energy) on a vessel.

FIG. 3 schematically shows an operating setup with energy flows for an installation of the winch system 100 on a vessel or a rig. As in the (prior art) system illustrated in FIG. 1, a combustion engine or gas turbine 1 may drive a generator 2 producing electrical power 3. Electrical motors convert the electrical power to mechanical power 4 of a winch, giving torque and speed to output 5 and respectively provide torque and speed to the winch drum and hoisting lines.

Mechanical power 4 can also be regenerated into electrical power 3, which can be stored in an electrical storage unit 6. In winch system 100, mechanical power can also be regenerated into hydraulic power 7 via the hydraulic motors 16*a* and/or 16*b*, and supplied to the hydraulic power system and the hydraulic energy storage unit 8, the embodiment shown in FIG. 2 being the high pressure accumulator 19 and an accumulator cylinder 20.

A low pressure accumulator 21 and accumulator cylinder 22 may also be used instead or in combination with the high pressure accumulator. (High and low pressure refers to the operating pressure of the respective motors and their specifications.) It will be appreciated that the hydraulic storage units (low pressure and high pressure) may be used as required depending on the storage capacity requirement.

When the winch system is lifting loads, where a load is typically measured as a force experienced by the winch, both the electrical and the hydraulic motors may be engaged to supply power to the winch drum 10 via the gear 12*a* and/or 12*b*. The hydraulic motors 15*a* and 15*b* will have their fluid power supplied from the high pressure accumulator 19 (i.e., the hydraulic energy storage unit 8), while the electric motors will have the power supplied from the electrical power system. Similarly, when lowering a load, both the electric and hydraulic motors may regenerate power and supply energy to the respective power systems for storage in the energy storage system or for immediate use by other consumers of energy. The winch system may be scaled up or down to increase (or decrease) the winch load capacity using additional motors and corresponding energy storage systems.

Figure 4:
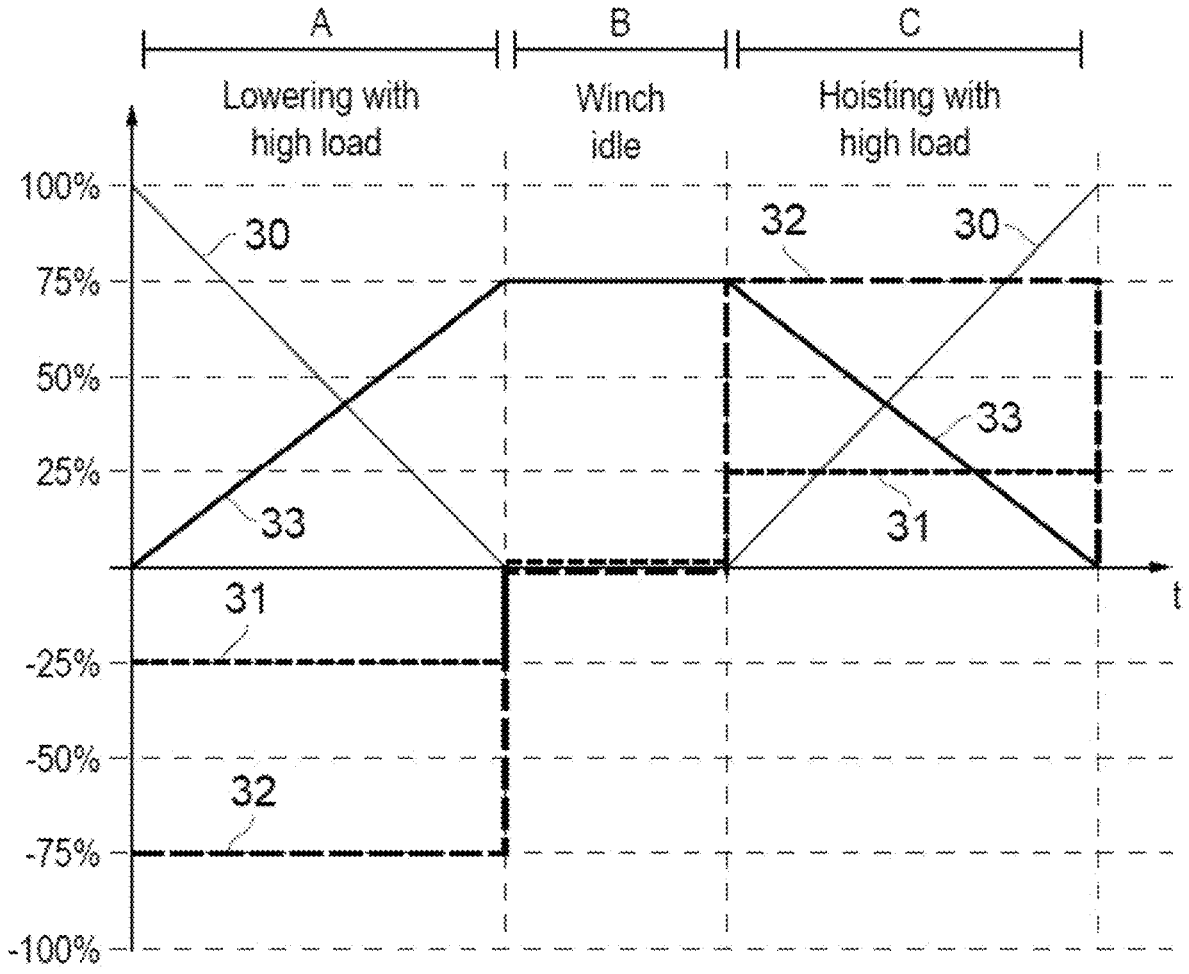
FIG. 4 illustrates energy consumption and energy recovery for a winch system embodying the present invention for an exemplary operational cycle.

FIG. 4 illustrates exemplary power consumption of the winch system plotted against time, t, for one operational cycle. During lowering with a high load, as shown in sequence A, the hook position 30, for example, a travelling block on a drilling rig, changes from the uppermost position (100%) to the lowermost position (0%). Power is generated during lowering, as 25% electric power and 75% hydraulic power, as can be seen by the negative electric power consumption 31 and hydraulic power consumption graph 32. The generated hydraulic energy is stored in the mechanical energy storage system (in this case, the hydraulic energy storage unit 8) to charge the hydraulic energy storage from an initial hydraulic charge level 33 of 0% to a charge level of 75% at the end of sequence A. The electrical power generated can be transferred to the electrical power system and/or the electrical energy storage system (such as a battery).

In sequence B, the winch is idle, and there is no power consumption or generation. The winch may be held in place using a braking system.

In sequence C, the load is hoisted. In this case, the stored hydraulic energy from the mechanical energy storage system is utilized to provide 75% of the lifting capacity and electric power is utilized to provide 25% of the lifting capacity (the electrical energy storage system may optionally provide some of the electrical energy). Full lifting capacity can thus be provided, but with the electric motor and electric supply only having to be dimensioned for a part of the load, as can be seen from the electric power consumption 31.

Figure 5:
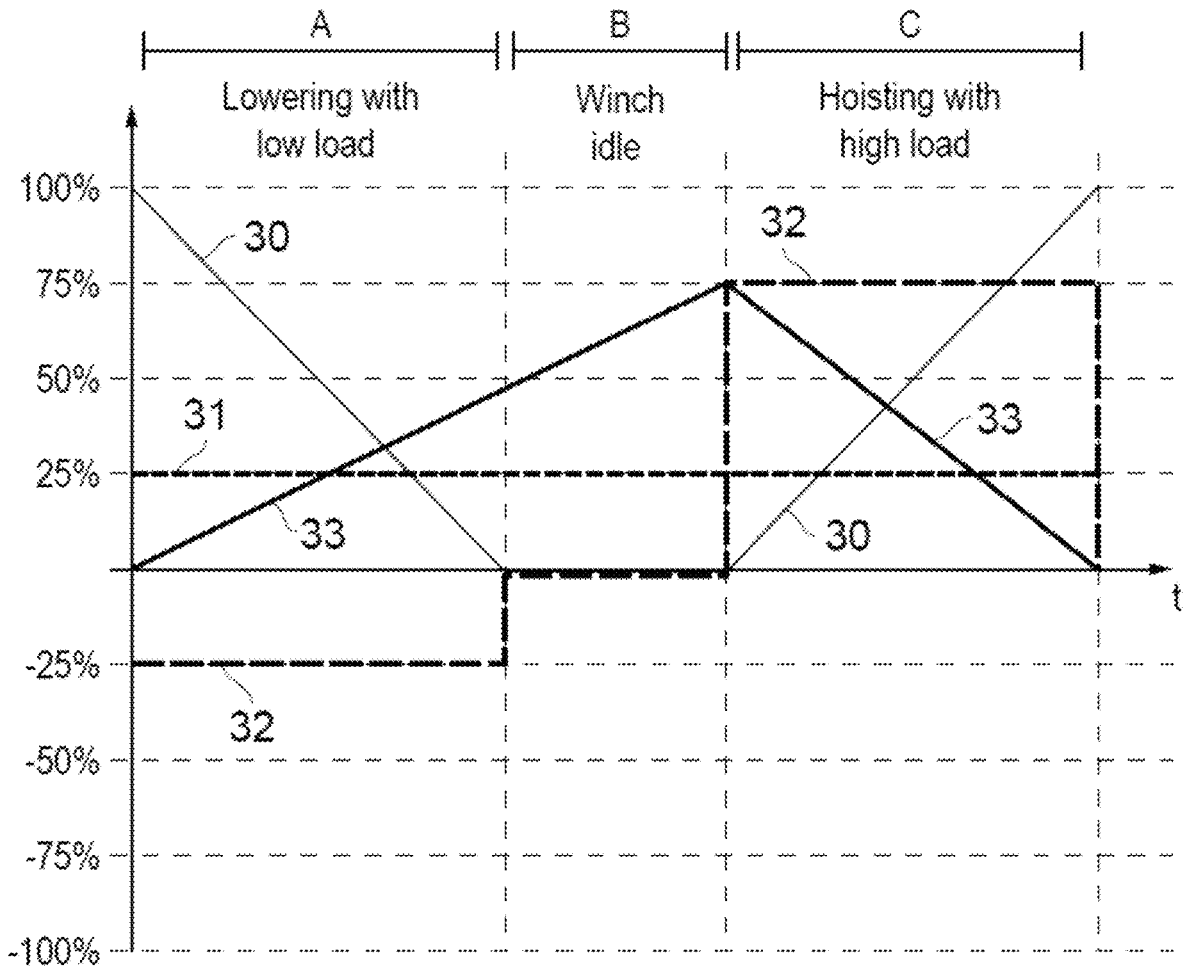
FIG. 5 illustrates the energy consumption for a second exemplary operational cycle.

FIG. 5 illustrates another operational cycle, in this case lowering with a low load (sequence A), a period where the winch is idle (sequence B), and hoisting with a heavier load (sequence C). This is typical, for example, in a tripping out sequence on a drilling rig where a drill string is hoisted a certain length, a section removed, the hook is lowered (with low or no load), and another length of drill string is hoisted.

In the cycle shown in FIG. 5, during lowering, the hydraulic motor 16*a* is controlled to regenerate hydraulic power to charge the mechanical energy storage system (for example, the hydraulic energy storage unit 8). The electric motor 15*a* is set to drive the hydraulic motor 16*a*, i.e., provide a positive power electric power consumption 31 although the load is being lowered. In this way, the charge level 33 in the hydraulic energy storage system 8 can be increased during the lowering sequence.

In sequence B, the winch is idle and is held in place by engaging brakes 14 (or holding the winch drum 10 in place by a second hydraulic motor 16*b* and/or second electric motor 15*b*). While the winch is idle and by decoupling clutch 13*a*, the electric motor 15*a* can continue to drive hydraulic motor 16*a* via gear 12*a* and thus continue to charge the mechanical energy storage system.

In sequence C, the stored mechanical energy (in the hydraulic energy storage unit 8) is utilized to provide hoisting energy for a higher load than the load which was lowered, in this case providing 75% of the power while the electric motor provides 25%. A greater lifting capacity can thus be obtained for repeated, asymmetric operations such as tripping out of a drill string, while the electric motor and electric supply only have to be dimensioned for a part of the maximum load.

Figure 6:
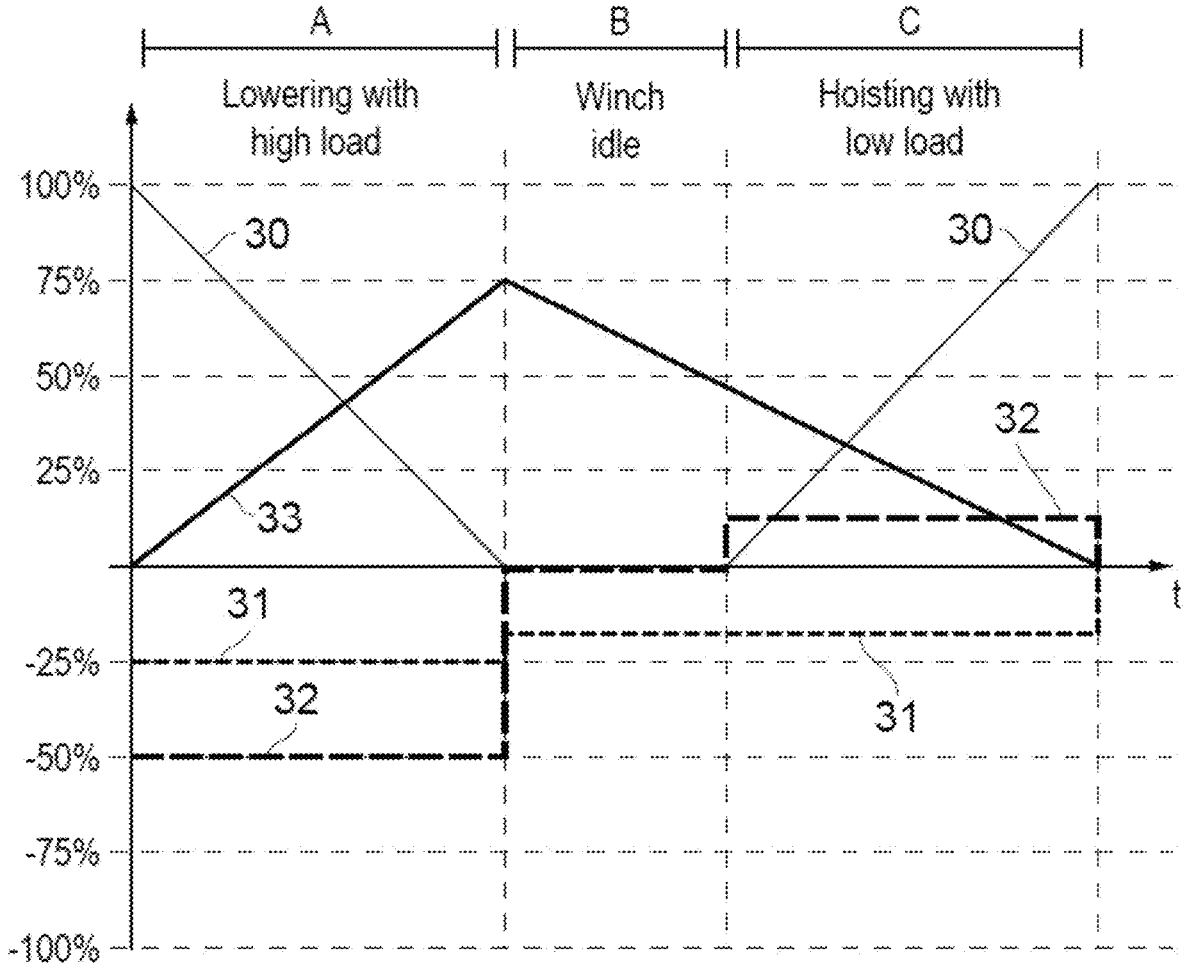
FIG. 6 illustrates the energy consumption for a third exemplary operational cycle.

FIG. 6 illustrates the power consumption for yet another operational cycle, in which lowering is done with a higher load and hoisting with a lower load, where the terms higher and lower refer to the relative force required to hoist the load. This cycle may, for example, be in a trip in sequence on a drilling rig. Such cycles are common in offshore drilling, for example, where heavy equipment (such as a blowout preventer) is lowered to the sea floor sequentially on a riser string (by adding riser segments) and a smaller load, e.g., only the hook, is hoisted back up.

In the cycle shown in FIG. 6, during lowering (sequence A), the electric power consumption 31 and hydraulic power consumption 32 are both negative, meaning power is being generated and may be stored in the respective energy storage systems. The hydraulic power is stored in the mechanical energy storage system (hydraulic energy storage unit 8), while the electric power is supplied to the grid or stored in the electrical energy storage system, e.g., batteries, however, other electrical power storage methods may be used as outlined above. During the idle sequence (B) of the winch, the clutch 13*a* is decoupled and some of the stored mechanical energy from the mechanical energy storage system is used to drive the hydraulic motor 16*a*. The hydraulic motor 16*a* via gear 12*a* uses the stored mechanical energy to maintain the electric motor 15*a* in regeneration mode.

During the hoisting sequence (C) with a lower load, the hoisting power may be provided entirely by the hydraulic motor 16*a*. The electric motor 16*a* may remain in regeneration mode, also driven by the hydraulic motor 16*a* with energy from the hydraulic energy storage system 8. Thus for the full cycle, electrical power can be regenerated, while the electric motor and supply lines need not be dimensioned for the maximum possible regeneration of power.

A system according to this embodiment of the present invention can significantly reduce installed electrical power supply requirements by using energy from the mechanical energy storage system and using periods of standstill to charge the mechanical energy storage system (e.g., accumulators) or transfer energy from the mechanical energy storage system (hydraulic energy) to electrical energy. The electrical power system, including the electrical motors, can be designed for average, as opposed to maximum, power consumption. Reducing the electrical power installed gives significant advantages, including less VFDs and thereby reduced cost, weight and space requirements.

In another embodiment, the energy between the motors and winch drum may be distributed using at least one of the gears 12*a* or 12*b*, where at least one of the gears is a planetary gear. FIG. 7 shows a planetary, or epicycle, planetary gear train 40 with planets engaging both a sun gear 43 and an annular gear 41. Using the planetary gear train 40 in gear 12*a*, the annular gear 41 is connected to the winch drum 10, the planet gear carrier 42 is connected to electrical motor 15*a*, and the hydraulic motor 16*a* is connected to the sun gear 43.

Using a planetary gear train 40 in a winch system according to the present invention allows the electric motor 15*a* to drive the hydraulic motor 16*a* without the need to engage the clutch 13*a*. This is achieved by engaging brakes 14 (or alternatively using a second hydraulic motor 16*a* or second electric motor 15*b* for this purpose, the term second referring to an additional motor for the purpose of braking or may be one of the other motors used to drive the winch in the winch system and used for braking) to fix the winch drum 10 and thus the annular gear 41, while power can be transferred between the planet gear carrier 42 and sun gear 43. If the electric motor 15*a* is held at a fixed position, the hydraulic motor 16*a* can drive the winch drum 10 and vice versa. The winch can hence operate in passive compensation mode or with constant tension.

In a further embodiment, the winch system according to the present invention is provided with heave compensation capability. Heave compensation on winches used in offshore drilling is well-known and provides the opportunity to maintain the position of the load 11 substantially constant in relation to the seafloor or wellbore. It is additionally possible to maintain a constant tension of a tubular, such as a riser or a drill string, extending from a floating vessel towards the seafloor.

One advantage of the winch system embodying the present invention is that less or no supply of electrical power may be needed when heave compensating for movement of the rig or vessel compared to electrical winches. Further, and optionally, the winch can be position controlled using a motion reference unit (MRU) which measures the acceleration of the rig or vessel and compensates for heave.

In an embodiment, the hydraulic motor(s) can be operating in a passive heave compensation mode using the energy from the mechanical energy storage system, for example, by accumulators having fluid power flow back and forward between hydraulic motors and accumulators, while the electric motors operate in an active heave compensation mode and add power to overcome friction in the system. Using both hydraulic and electrical motors provides a highly responsive system, but without the need for a large electric power supply since the electric motors can only be used to overcome friction. Such means to provide heave compensation, as a combination of active and passive heave compensation, without adding substantial amounts of electrical power, is highly beneficial in some critical operations within drilling and the marine industry.

Figure 8:
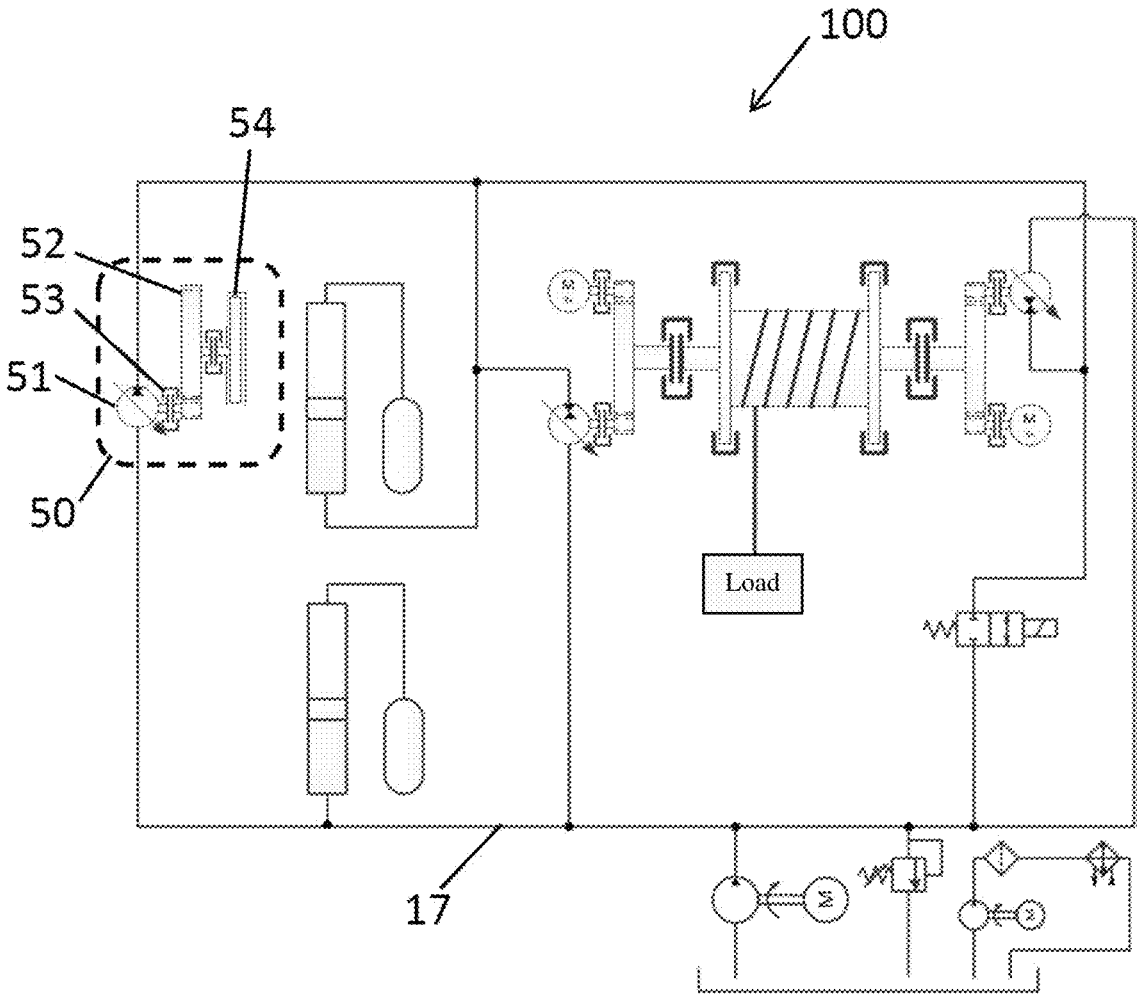
FIG. 8 illustrates an embodiment of the present invention comprising a hydraulic energy storage unit comprising a flywheel.

In an embodiment, shown in FIG. 8, a further example of a mechanical energy storage system comprising a flywheel storage unit 50 is provided. The flywheel storage unit 50 comprises a hydraulic motor 51 coupled to a gear 52 via a clutch 53. The flywheel storage unit 50 is connected to the distribution line 17. The gear 52 is coupled to a flywheel 54. The winch system 100 shown in FIG. 8 is otherwise identical to that shown in FIG. 2 and the flywheel 54 may be used in place of the accumulators and hydraulic cylinders or in addition as supplementary energy storage.

By controlling the hydraulic motor 51, the flywheel storage unit 50 can be charged when there is regenerative power available by having the load-induced hydraulic pressure (e.g., during lowering of heavy loads) drive the hydraulic motor 51, or by using the electric motors to generate hydraulic power to charge the flywheel storage unit 50. Similarly, energy from the flywheel can be added to the distribution line 17 by having the flywheel 54 run the hydraulic motor 51 using the stored mechanical energy.

Figure 9:
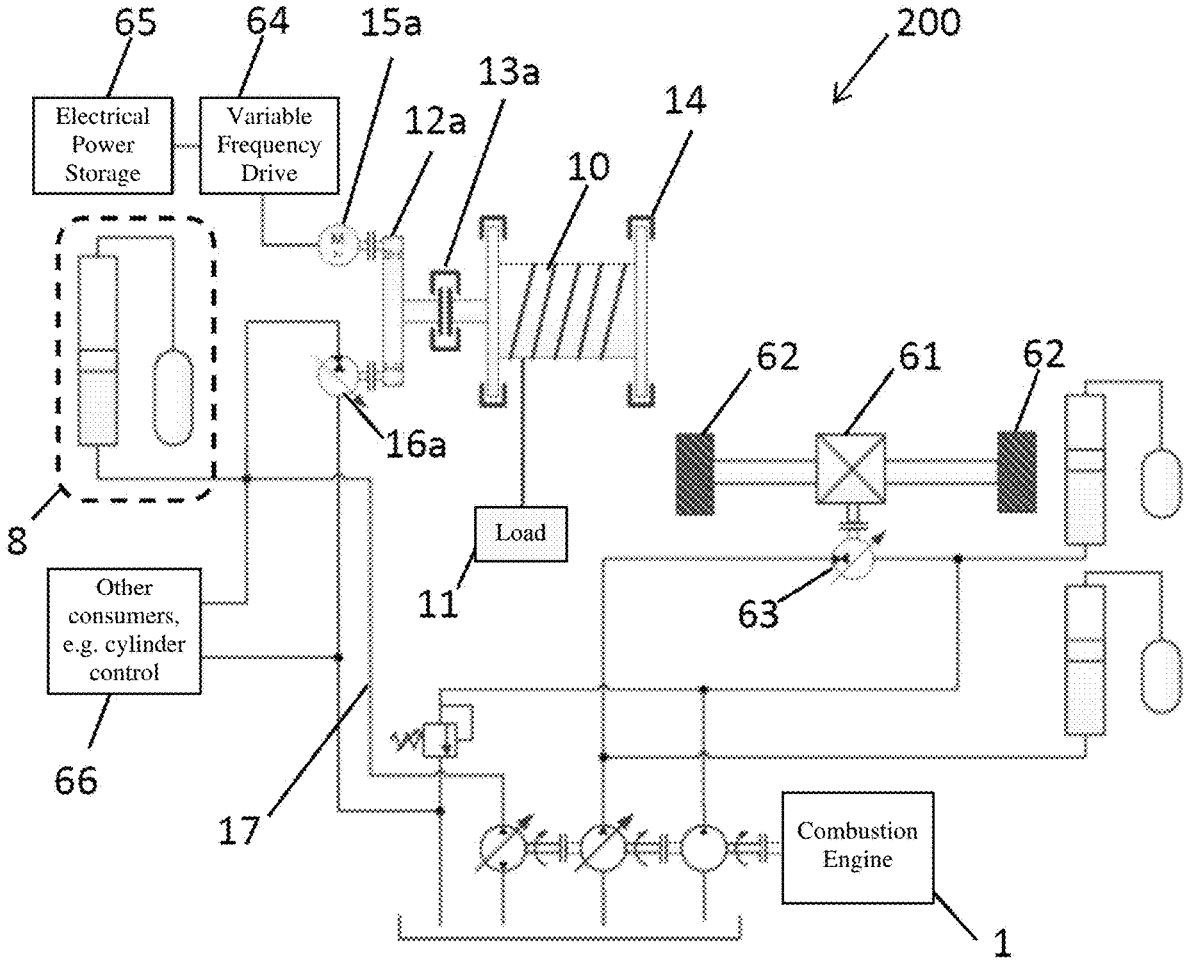
FIG. 9 illustrates an embodiment of the invention suitable for use in mobile applications, showing optional components.

A further embodiment provides a winch system 200 for a mobile application as is shown in FIG. 9. The winch system comprises a drive train 61, where the drive train 61 may be powered hydraulically by hydraulic motor 63 and drive a mobile unit via wheels 62. The mobile unit may be, for example, a mobile crane vehicle.

The system further comprises a winch having a winch drum 10 for hoisting a load 11. The winch, also described in further detail above, is powered through a gear 12*a* connected to the winch drum 10, and driven by an electric motor 15*a* and a first hydraulic motor 16*a*, both connected to the gear 12*a*. A clutch 13*a* may optionally be provided to disengage the gear 12*a* from the winch drum 10. The mobile unit may comprise any of the features of the embodiments above adapted for the mobile unit, if necessary.

Hydraulic power is distributed through distribution line 17, from a hydraulic power unit, the hydraulic power unit may comprise, for example, a combustion engine 1, however, any means to deliver hydraulic power may be used. In a further alternative, there may be no local power source on the mobile unit, its operation being powered by electric and/or hydraulic energy from an alternative mechanical energy storage system (stored energy) or other source.

The mobile system may further comprise an electric energy storage unit 65, such as a battery, electrically coupled to the electric motor 15*a* via a variable frequency drive unit 64.

During operation, the combustion engine 1 drives one or more hydraulic pumps, which is (are) connected to hydraulic motors 16*a* and 63 to drive the winch and the drive train. Typically, hydraulic accumulators, such as hydraulic energy storage system 8, are used to store regenerative hydraulic power. Other hydraulic consumers 66 may also be coupled to the hydraulic distribution line 17.

Since mobile applications generally have limited space, and hydraulic accumulators require significant space if large amounts of energy are to be stored, advantages can be achieved by storing some energy electrically through an electrical energy storage unit, such as batteries of cells. The power stored in the electrical energy storage unit 65 can be used to add energy when hoisting or, when the winch is not in operation, the system can be used to supply fluid power to other consumers or converting fluid power to heat.

In an embodiment, by providing a clutch to disengage the drum, or by providing a planetary gear, the system allows for the conversion of hydraulic power to electric power or vice versa both during normal operation or when the mobile unit is idle. This allows a control system to, at any time, maintain an optimum energy storage level in the system according to the current or projected operational characteristics of the mobile unit.

A further advantage of winch systems embodying the present invention is that the dependence on any single source of energy, either mechanical (hydraulic based), electrical or chemical (combustion engine) can be reduced by transferring the energy requirement to one of the other sources in the winch system. For example, the load on the combustion engine will be in average lower, due to the possibility of regenerating power both electrically and hydraulically. The load on the combustion engine will moreover have less variation, giving reduced fuel consumption and $CO_2$ emissions.

Further energy sources may be used to supplement the mobile winch system where needed in the mobile unit. For example, an internal combustion engine may provide supplementary energy to the winch system, may be integrated with the winch system as an additional motor, and/or may optionally be controlled by the control system.

Figure 10:
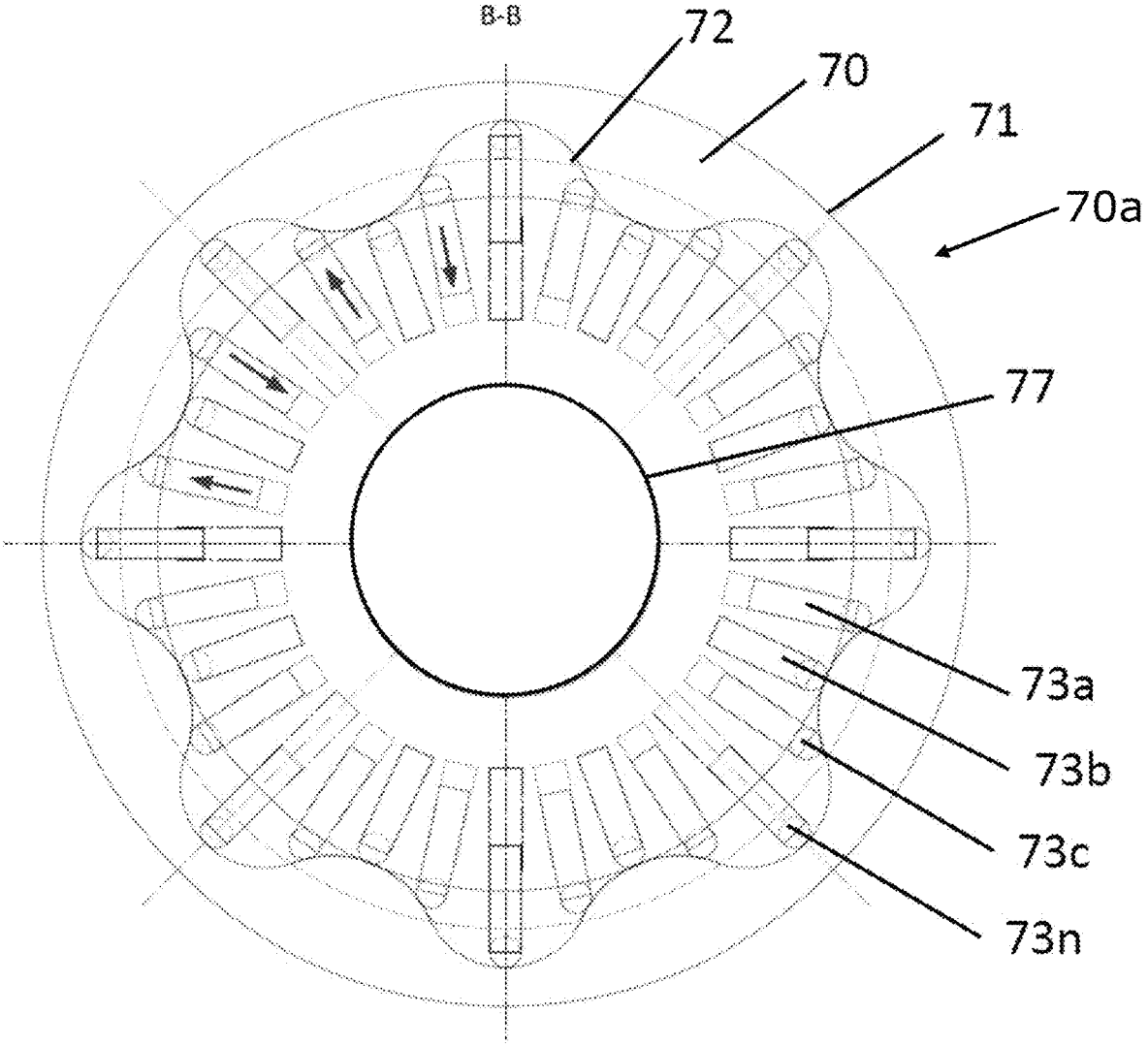
FIG. 10 illustrates a drum motor with hydraulic actuators and a modulated profile of a cam ring.
Figure 11:
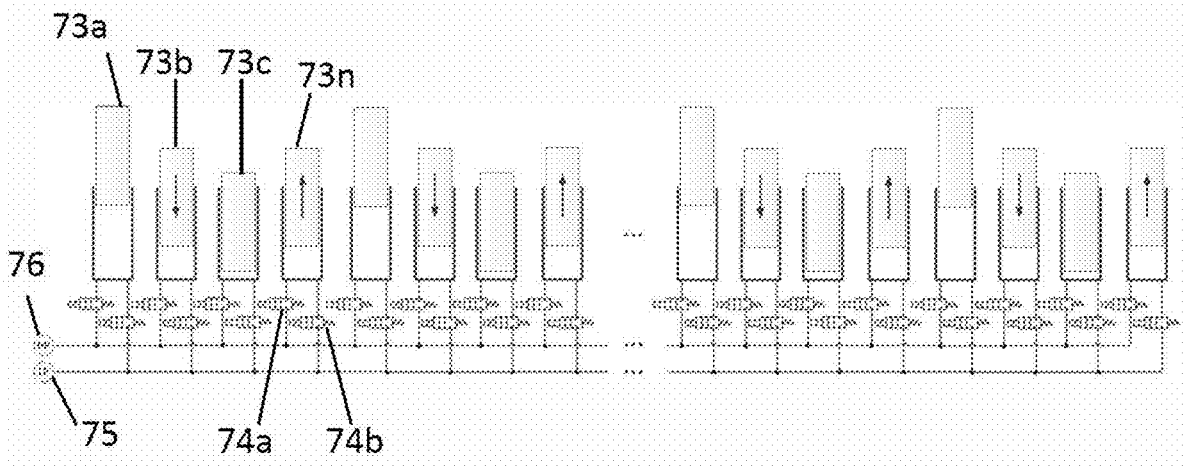
FIG. 11 illustrates the action of hydraulic actuators and respective high and low pressure valves.

FIGS. 10 and 11 show a hydraulic drum motor 70*a* having an inner stationary part 77, for example, an axial inner shaft, a plurality of radially mounted hydraulic cylinders 73*a-n* arranged radially around the axial inner shaft, and a cam ring 70. The cam ring 70 can optionally be attached using an attachment device to a winch drum 10. Two on/off hydraulic valves 74*a* and 74*b*, which may be operated electrically or mechanically, are connected to each of the hydraulic cylinders 73*a-n* of the inner stationary part 77. One of the on/off hydraulic valves 74*b* is connected to a low pressure hydraulic line 75, while the other valve 74*a* is connected to a high pressure hydraulic line 76.

The inner surface of the cam ring 70 is provided with a modulated profile 72. The modulated profile 72 may be sinusoidal, or any other suitable profile with which the on/off hydraulic cylinders 74*a-n* engage. The outer surface 71 of the cam ring 70 may form a portion of a winch drum or may be the winch drum itself which winds the wireline or other flexible element. The hydraulic cylinders 73*a-n* engage with the modulated profile 72 using an engagement member that allows the hydraulic cylinders 73*a-n* to drive the cam ring 70 by virtue of the modulated profile 72. For example, the engagement member may be a roller, slider, or any other means that allows the hydraulic cylinders 73*a-n* to effectively engage with the modulated profile 72 to drive the cam ring 70.

Figure 14:
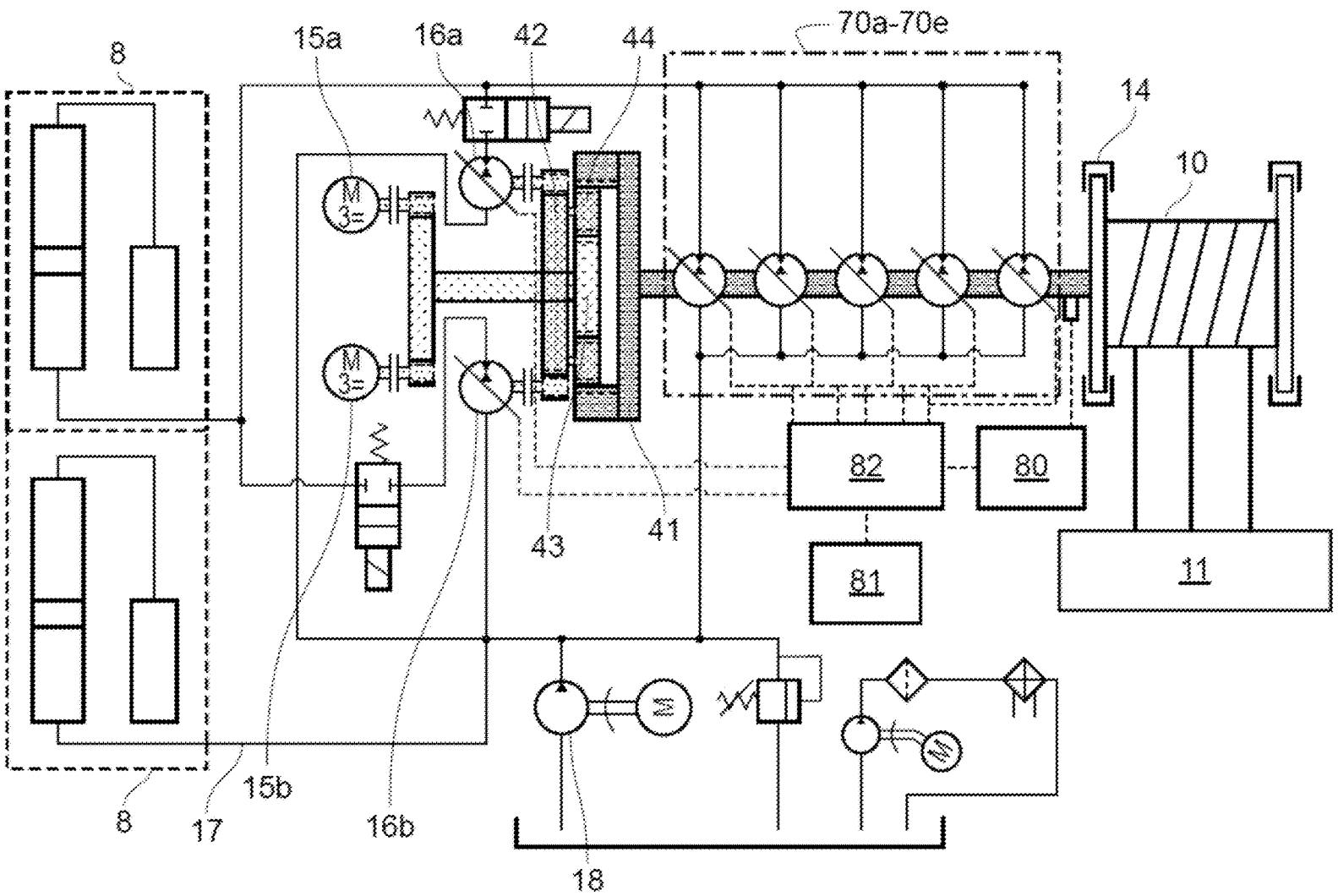
FIG. 14 illustrates a hybrid winch system embodying the present invention.

A drum motor control system module 82 (see FIG. 14) is used to control the drum motor. The drum motor control system module 82 controls the opening and closing of the two on/off hydraulic valves 74*a* and 74*b* based on the position of the cam ring (e.g., through a rotational measuring device 80, such as a pulse encoder, as shown in FIG. 14), the hydraulic cylinders 73*a-n* can thereby work as a motor, pump or being idle.

When working as a motor, the cylinders of the drum motor are pressurized when extending on the cam ring 70 making the cam ring 70, and any attached winch drum, rotate. By varying the number of cylinders being idle, the torque of the drum and thus the wire tension of the winch can be controlled accordingly. The high and low pressure hydraulic lines attached to the valves can, for example, have a constant pressure and hence the operating conditions of each cylinder will remain unchanged even if the hydraulic drum motor and/or winch system is working at partial load. Constant working conditions mean that the design of the hydraulic cylinders 73*a-n* can be optimized for these conditions, giving a better efficiency.

The drum motor used as a winch drum or attached to a winch drum reduces mechanical energy losses normally experienced in gearboxes used in typical winch applications. Low mechanical losses are extremely important for optimizing energy use and minimizing the requirement to distribute energy through a gearbox or mechanical transmissions, leading to increased energy efficiency of the winch. For example, when operating for heave compensation or regenerating energy, energy must be transferred through mechanical paths, e.g., the gearing system, at least twice, both during driving and then braking of the winch drum. Using the drum motor as the winch drum or directly attached to a winch drum reduces the energy lost through the gearing system.

Reducing energy losses in the gearing system allows the hybrid winch system to be more energy efficient. At least one advantage of using the drum motor is a significant reduction in the energy usage when operating for heave compensation since the energy is regenerated without any significant losses.

Energy wise, the drum motor system for a winch may operate in a passive heave compensation mode, but requires the drum control system module to actively control the opening and closing of the valves according to the drum position, speed and torque required.

A further advantage of the drum motor becomes apparent in the event that a fault develops with the valves, or hydraulic cylinders. The drum motor control system module can adapt to compensate for the failure by switching off any failed cylinders and rebalance the motor by selecting which hydraulic cylinders, and corresponding valves, to keep in operation for a continued operation of the winch system.

A further advantage is that the plurality of similar components provides an inherent redundancy and operational flexibility. Since the winch drum motor torque and speed can be controlled by engaging and disengaging cylinders, a constant supply pressure can be used, and there is no need to adjust the pressure to vary the torque or tension of the winch as is required for other cylinder tensioning systems. Moreover, only a subset or selected hydraulic cylinders 73*a-n* can be operated, according to the operational requirement at any given time. If a valve or cylinder has a fault or reduced performance, another set of components can be chosen, thereby maintaining the performance and operational integrity of the system.

As a non-limiting design example, the drum motor as shown in FIG. 10 may have 32 cylinders with a piston diameter of 120 mm, a cylinder stroke of 600 mm, and 64 electrical operated on/off valves.

Figure 12:
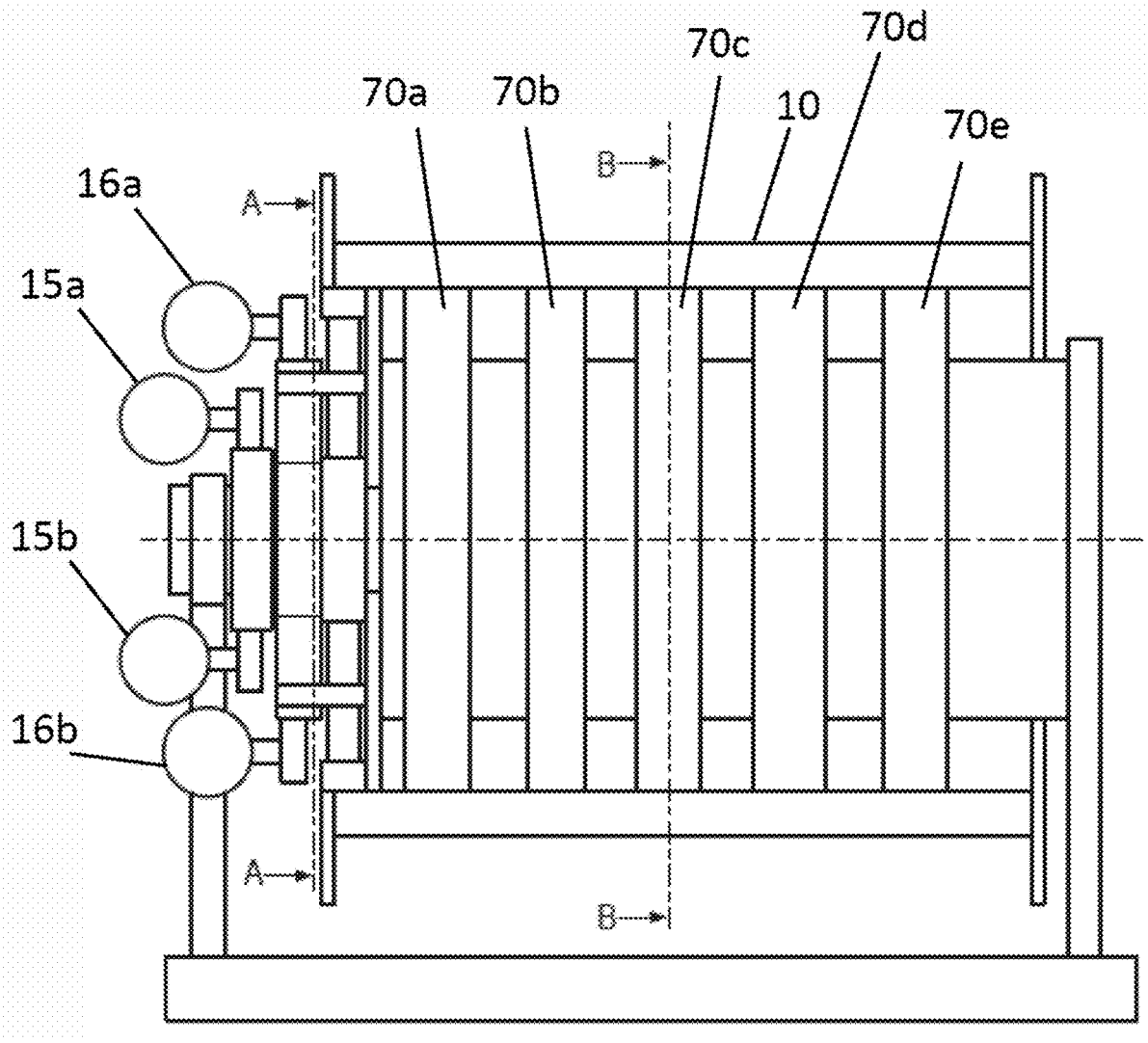
FIG. 12 illustrates a side profile of a hybrid winch embodiment using a plurality of drum motors, a planetary gear system, and a combination of electric and hydraulic motors.

FIG. 12 shows a hybrid winch system comprising two electric motors 15*a* and 15*b*, two hydraulic motors 16*a* and 16*b*, coupled to a winch drum 10 via a gear, and five drum motors 70*a-e*.

The setup of FIG. 12 uses 5 drum motor sections (with cam rings being visible for each drum motor 70*a-e*), with optional intermediate spacers. The motor sections can be combined so that the cam ring and the axial shaft of a first drum motor can be coupled to a second drum motor. In an embodiment, a plurality of drum motors may be coupled to together to form a battery of drum motors for larger winch loads or as design may require for a winch system. The outer surfaces of the cam rings of the battery of drum motors may form the winch drum or at least a portion of the winch drum. Alternatively, a winch drum may be attached to the outer surfaces of the cam rings.

The drum motor may be incorporated into the aforementioned winch system embodiments. The winch drum of the winch system comprises the drum motor as detailed above and forms a hybrid winch system, with the sectional view B-B indicated in FIG. 12 corresponding to FIG. 10. The drum motor control system module may be incorporated into the control system of the winch system embodiments and manage energy distribution and optimization of the hybrid winch system in a similar manner to that of the winch system, where the drum motor may be treated as an additional motor linked to drive the output.

The examples using five drum motor sections are non-limiting. The number of drum motors and gears may assume any of the configurations or combinations of configurations outlined in this disclosure, as well as configurations known to the skilled person.

Figure 13:
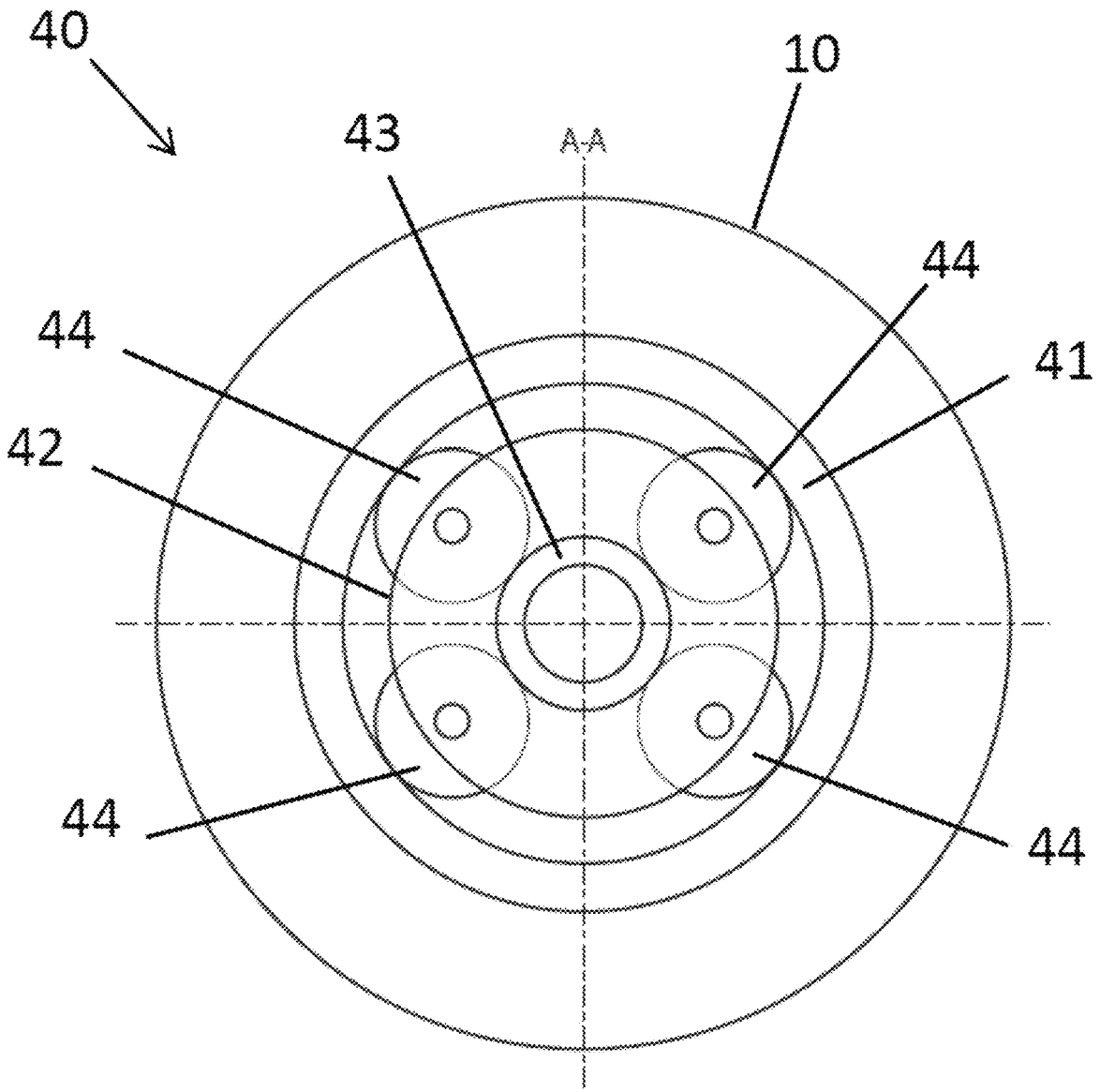
FIG. 13 illustrates the planetary gear of an embodiment of FIG. 12.

FIG. 13 shows the view A-A (see FIG. 12) of a planetary gear in a hybrid winch system. Reference is also made to FIGS. 7 and 14. The annular gear 41 is connected to the winch drum 10 and works in interaction with set of planet gears 44, which again are connected to a planet gear carrier 42. In the center is a sun gear 43 working in interaction with the planet gears 44. The hydraulic motors 16 and 16*b* are coupled to the planet gear carrier 42 (see FIG. 14). The electric motors 15*a* and 15*b* are coupled to the sun gear 43. The hydraulic motors 16*a* and 16*b* are controlled by the drum motor control system module 82, and can be controlled to operate the drum motor both as a pump or a motor. To isolate the motors, an on/off valve is connected to the high pressure inlet of the motor. The electrical motors 15*a* and 15*b* are controlled by VFD and a control system, and can both add power or regenerate power.

FIG. 14 shows further details of the embodiment of the hybrid winch system. A rotational measuring device 80 is provided in relation to the axial inner shaft, measuring the rotational speed and position of the cam ring. The information from the rotational measuring device 80 is communicated to the overall control system (not shown) and the control system module 82 to control the energy distribution and energy generation. The generated energy by the hydraulic motors 15*a*, 15*b* and 70*a-e* may be stored using the respective energy storage system 8.

Hoisting and lowering can be done by using the electric motors 15*a* and 15*b*, the hydraulic motors 16*a* and 16*b*, drum motors 70*a-e*, or any combination of these motors. When only electric motors are being used, the planet carrier 42 and its hydraulic motors 16*a* and 16*b* may be locked and the drum motors 70*a-e* may be in idle, and when only the hydraulic motors 16*a* and 16*b* are being used the electrical motors 15*a* and 15*b* may be locked and drum motors 70*a-e* in idle. When the drum motors 70*a-e* are used, the electrical or hydraulic motors can be locked. The available combinations possible for hoisting and lowering, with associated energy distribution and/or regeneration give a unique operational flexibility.

When braking a load 11, energy can be both transferred via the electrical motors 15*a* and 15*b*, the hydraulic motors 16*a* and 16*b*, and the drum motors 70*a-e* to store the energy in a power storage system, either as electrical power or fluid power. The power can later be reused, and thus the power supply to the winch system can be dimensioned according an average (rather than peak) consumption. In periods of standstill and even periods where the winch is operated by the drum motors, the electrical and hydraulic motors can transfer power to or from the energy storage systems depending on mode of operation (such as trip-in, trip-out etc.).

When operating in heave compensation mode, the drum motors 70*a-e* may be balanced against the load by adjusting the displacement of the drum motors working against the hydraulic-gas accumulators. Since the drum motors 70*a-e* are acting directly on the winch drum 10, no gearbox with losses is used. This provides high efficiency and good heave compensation performance. However, to compensate for gas pressure changes and any other friction, such as sheave friction and flow losses, either or both the electrical or hydraulic motors can be actively controlled using information from a motion reference unit (MRU) 81 detecting the vessel's motion. This is known as active heave compensation (AHC). By using, for example, the electric motors 15*a* and 15*b* in active compensation mode to account for system friction, while the drum motors 70*a-e* provides the majority of the heave compensation effect in passive mode, improved compensation performance can be achieved.

Other embodiments may comprise components which perform the same function but are of a different form. The components may be interchangeable with one another or may supplement an existing component.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realising the invention in diverse forms thereof. Reference should also be had to the appended claims.

What is claimed is:

1. A winch system for driving an output, the winch system comprising:

a gear connected to the output;

an electric motor connected to the gear;

a hydraulic motor connected to the gear;

an electric power system; and a hydraulic power system, wherein, the electric motor is connected to the electric power system, the hydraulic motor is connected to the hydraulic power system, the electric motor and the hydraulic motor are configured to distribute energy via the gear to the output and to distribute the energy between each other via the gear, and, the energy distributed between the electric motor and the hydraulic motor is further distributed to the respective electric power system and hydraulic power system.

2. The winch system as recited in claim 1, further comprising:

an electric energy storage unit; and a hydraulic energy storage unit, wherein, the further distributed energy is stored by the electric power system in the electric energy storage unit and by the hydraulic power system in the hydraulic energy storage unit.

3. The winch system as recited in claim 2, wherein the hydraulic energy storage unit is at least one of an accumulator, an accumulator cylinder, and a flywheel.

4. The winch system as recited in claim 2, further comprising:

a heave compensation module, the heave compensation module being configured, to control an energy distribution between the electric power system, the hydraulic power system, and the output using the electric motor, the hydraulic motor and the gear, or to control an energy distribution between the electric power system, the hydraulic power system, and the output using the hydraulic motor to provide a passive heave compensation and the electric motor to provide an active heave compensation.

5. The winch system as recited in claim 4, wherein the heave compensation module is further configured to control the energy distribution to overcome frictional forces.

6. The winch system as recited in claim 1, further comprising:

a winch drum, or a clutch connected to a winch drum, wherein, the output is connected to at least one of the winch drum and the clutch connected to the winch drum.

7. The winch system as recited in claim 1, wherein the gear is at least one of a planetary gear train and a series of gears.

8. The winch system as recited in claim 1, further comprising:

a mobile unit comprising a power source configured to move the winch system.

9. The winch system as recited in claim 1, further comprising a drum motor which comprises:

an axial inner shaft;

an array of hydraulic cylinders arranged radially around the axial inner shaft; and a cam ring comprising an internal surface which comprises a modulated profile in a radial direction, wherein, the array of hydraulic cylinders is arranged between the axial inner shaft and the modulated profile of the cam ring, and an actuation of the array of hydraulic cylinders rotatably drives the cam ring around the axial inner shaft.

10. The winch system as recited in claim 9, wherein the drum motor is configured to receive and distribute the energy to at least one of the electric motor and the hydraulic motor using the gear.

11. A method for operating a winch system, the winch system being configured to drive an output, the winch system comprising, a gear connected to the output, an electric motor connected to the gear, a hydraulic motor connected to the gear, an electric power system, and a hydraulic power system, wherein, the electric motor and the hydraulic motor are configured to distribute energy between each other and to the output via the gear, the electric motor is connected to the electric power system, the hydraulic motor is connected to the hydraulic power system, and the energy distributed between the electric motor and the hydraulic motor is further distributed to the respective electric power system and hydraulic power system, the method comprising, during a hoisting operation, a lowering operation, or an idle state of the winch system:

distributing energy from the electric motor to the hydraulic motor via the gear, or distributing energy from the hydraulic motor to the electric motor via the gear.

12. The method as recited in claim 11, further comprising at least one of:

during the lowering operation or the idle state of the winch system, inputting energy to the gear from the hydraulic motor or from the electric motor; and during the hoisting operation or the idle state of the winch system, extracting energy from the gear by the hydraulic motor or by the electric motor.

* * * * *